US009475672B2

(12) United States Patent
Rennebod

(10) Patent No.: US 9,475,672 B2
(45) Date of Patent: Oct. 25, 2016

(54) TUBULAR CYLINDER

(75) Inventor: Jes Bo Rennebod, Odense NØ (DK)

(73) Assignee: JES BO RENNEBOD, Odense No (DK)

( * ) Notice: Subject to any disclaimer, the term of this patent is extended or adjusted under 35 U.S.C. 154(b) by 458 days.

(21) Appl. No.: 13/697,074

(22) PCT Filed: May 11, 2011

(86) PCT No.: PCT/DK2011/050161

§ 371 (c)(1),
(2), (4) Date: Jan. 18, 2013

(87) PCT Pub. No.: WO2011/141032

PCT Pub. Date: Nov. 17, 2011

(65) Prior Publication Data

US 2013/0112793 A1 May 9, 2013

(30) Foreign Application Priority Data

May 11, 2010 (DK) ..... 2010 70202

(51) Int. Cl.

| | |
|---|---|
| ***B65H 75/02*** | (2006.01) |
| ***B65H 23/025*** | (2006.01) |
| ***B65H 27/00*** | (2006.01) |

(52) U.S. Cl.

CPC ..... *B65H 75/02* (2013.01); *B65H 23/0251* (2013.01); *B65H 27/00* (2013.01); *B65H 2406/11* (2013.01); *B65H 2406/15* (2013.01)

(58) Field of Classification Search

CPC ..... B65H 23/24
USPC ..... 242/615
See application file for complete search history.

(56) References Cited

U.S. PATENT DOCUMENTS

| | | | | |
|---|---|---|---|---|
| 5,649,890 | A | 7/1997 | Lapp et al. | |
| 5,868,386 | A * | 2/1999 | Stiel et al. | 271/195 |
| 6,004,432 | A * | 12/1999 | Page et al. | 162/281 |
| 6,113,059 | A * | 9/2000 | Couillard | 248/694 |
| 6,125,754 | A * | 10/2000 | Harris | 101/420 |
| 6,382,100 | B1 * | 5/2002 | Satoh et al. | 101/212 |
| 2002/0134882 | A1 * | 9/2002 | Lind | 242/615.12 |
| 2006/0278360 | A1 * | 12/2006 | Solberg | 162/272 |

FOREIGN PATENT DOCUMENTS

| | | |
|---|---|---|
| EP | 0 681 974 A1 | 11/1995 |
| GB | 492143 | 2/1938 |
| JP | 5-329347 | 12/1993 |
| WO | WO 2006/132873 A1 | 12/2006 |

OTHER PUBLICATIONS

WO 2006/132873 A1 May 2006 Solberg, Bruce.*

* cited by examiner

*Primary Examiner* — Emmanuel M Marcelo
*Assistant Examiner* — Justin Stefanon
(74) *Attorney, Agent, or Firm* — Fitch, Even, Tabin & Flannery LLP

(57) ABSTRACT

A tubular cylinder (2) is disclosed for handling plastic film webs in connection with production of thin plastic film, e.g. thin packing film. The cylinder (2) includes an outer tube (4) having radial apertures (6) that communicate with an inner tube (8) which is coaxial relative to the outer tube (4). Radial longitudinal partitionings (10) divide the space between the inner and outer tube into longitudinal curving ducts (12). The inner tube (8) is connected with a tubular duct (14) for the supply of air. The cylinder (2) includes bearings at opposite ends which rotatably support the cylinder (2) to rotate. The radial nozzle apertures (6) are disposed along two helical lines so that a helix at the first side of the center plane (20) is wound in a direction opposite a helix at the second side of the center plane (20). The radial nozzle apertures (6) are disposed at an outward angle outward relative to the radial center plane.

6 Claims, 2 Drawing Sheets

TUBULAR CYLINDER

BACKGROUND OF THE INVENTION

1. Field of the Invention

The present invention concerns a tubular cylinder particularly for use in handling webs of plastic film in connection with production of thin plastic film.

2. Description of the Prior Art

Production of thin plastic films—e.g. thin packing films—occurs based on a thin plastic bag made by blowing, e.g. with a thickness of 8 μm.

After blowing, the thin plastic bag is worked via a system of rollers into a flattened double plastic bag, e.g. with a width of about 3700 mm. With the object of tensioning wide plastic films in production, special reversing rollers are used as it is very important that the film is kept properly tensioned such that it will not become creased or deformed.

U.S. Pat. No. 6,125,754 discloses a channeled roller, used in association with flexible webs, which is provided with a pressurized gas flow, and which may be used to remove web wrinkles, clean webs, and roller, brake rollers, and hest, cool, moisturize, and dry webs. In operation, gas flow travels through the roller channels and applies non-contact forces to the web, thereby removing wrinkles and providing other types of beneficial web treatment.

SUMMARY OF THE INVENTION

The invention is particularly suited for keeping a plastic film tensioned, i.e. without creasing or deforming the plastic film.

The tubular cylinder according to the invention is characterised in that radial nozzle apertures in an outer tube are arranged along two helical lines, and that a helix at one side of the center plane is wound in a direction opposite the helix at the other side of the center plane, and that the radial nozzle apertures are angled outwards relative to the radial center plane.

With simple technical measures, a cylinder in accordance with the invention has a substantially improved ability to keep a web of plastic film stretched in tension and free from creases and even without the plastic film being subjected to deformation forces.

This arrangement with outwardly inclining radial nozzle apertures has the effect that during operation, i.e. when air is discharged through the nozzle apertures, by passage of a thin, e.g. flattened bag-shaped plastic film web (with a total thickness of the magnitude 2×8 μm) around the tubular cylinder, a supporting air film is formed which due to the outwardly inclining nozzle apertures will have a smoothening or tensioning effect, which—without producing any kind of deformation forces—contributes to counteracting formation of creases in the plastic film web.

The tubular cylinder according to the invention is suitably designed such that that the outwardly directed angle of the radial nozzle apertures is between 1° and 50°, preferably about 15° relative to the radial centre plane.

Preferably, the tubular cylinder according to the invention is additionally designed such that the spacing between the helical center lines measured along the outer side of the outer tube is between 5-50 mm and preferably is 22.5 mm.

With the objective of optimizing the action on a given plastic film web, the tubular cylinder according to the invention is designed such that the nozzle apertures have a diameter of between 0.5 and 5 mm and preferably 2.5 mm.

The tubular cylinder according to the invention may advantageously further be designed such that for the supply of air, the tubular duct in a way which is known extends in length inwards into the inner tube such that the injected air is partly conducted back along the outer side of the tubular duct to the left end of the inner tube and partly to the right end of the inner tube for introduction into the longitudinal curving air ducts and onwards radially out through the outwardly inclining nozzle apertures of the outer tube.

With the objective of optimizing the airflow outward through the radial nozzle apertures, the tubular cylinder according to the invention may further be designed such that at opposite ends, by radial connections between the inner side of the inner tube and the longitudinal curving air ducts, longitudinally displaceable regulators (regulating means) are provided for optimizing the resulting airflow out through the inclined nozzle apertures.

The tubular cylinder according to the invention may furthermore particularly advantageously be designed such that the longitudinally displaceable regulators include arrestors (arresting means) which, opposite the longitudinal curving air ducts, are accessible through externally open, elongated openings.

The tubular cylinder according to the invention may in a simple way be designed such that the arrestors are pointed screws interacting with an inner wall of the longitudinal curving air ducts.

With the objective of optimizing, i.e. prolonging, the service life of the tubular cylinder according to the invention, the cylinder may advantageously be designed such that at least one of the bearings (bearing means) includes an adjustable stopper (stopper means) for regulating the working position of the cylinder to avoid the effects of wear on the cylinder, the cylinder may, for example, be turned 180°.

BRIEF DESCRIPTION OF THE DRAWINGS

The invention is explained more closely in the following with reference to the drawing, on which:

FIG. 3;

FIG. 3.

DETAILED DESCRIPTION OF EMBODIMENTS OF THE INVENTION

Figure 1:
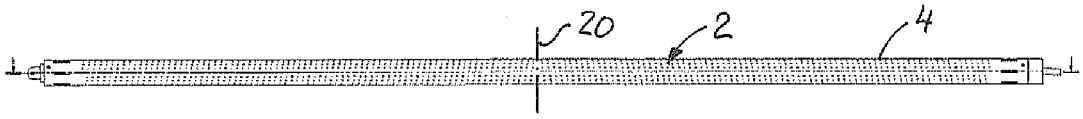
FIG. 1 shows a plan view of an embodiment of a tubular cylinder according to the invention, as seen from a rear side.
Figure 2:
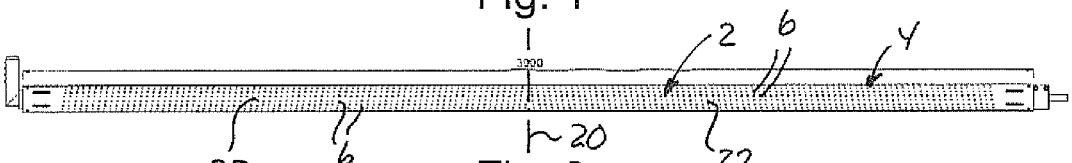
FIG. 2 shows a plan view of the cylinder shown in FIG. 1, as seen from the top.
Figure 3:
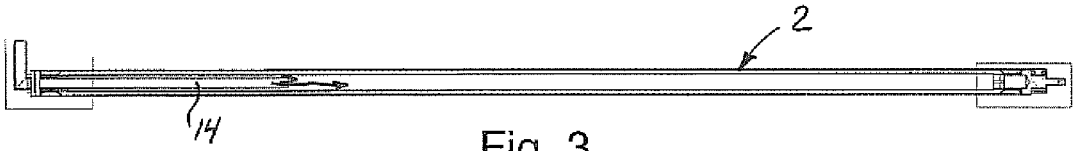
FIG. 3 shows a plan view, partly in section, of the cylinder shown in FIG. 2.
Figure 4:
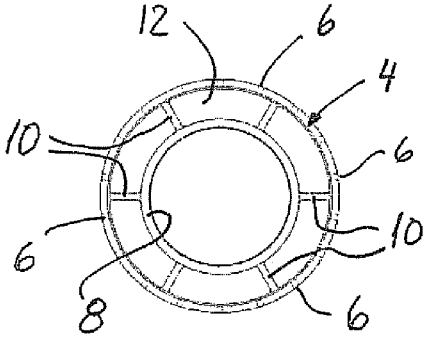
FIG. 4 shows a plan sectional view through a tubular cylinder according to the invention.

The tubular cylinder 2 shown in FIGS. 1-4 has an outer tube 4 provided with a large number of nozzle apertures 6 to which air is supplied by longitudinal curving air ducts 12 which are formed by radial partitionings 10 between the outer tube 4 and an inner tube 8.

Figure 5:
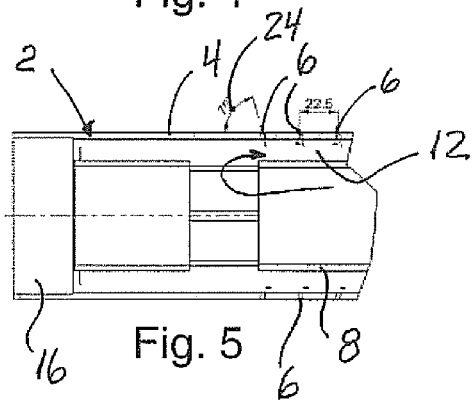
FIG. 5 shows a plan sectional view of an end part of a tubular cylinder according to the invention.

The nozzle apertures 6, which, for example, have a diameter of 2.5 mm, are provided at each side of a center plane 20 and are arranged along helical center lines 22 with mutual spacing of, for example, 22.5 mm. In other words, the radial nozzle apertures 6 in the outer tube 4 are arranged along two helical lines, and a helix on a first side of the center plane 20 is wound in a direction opposite a direction the helix is wound on the other side of the center plane 20. In addition, the radial nozzle apertures 6 (FIG. 5, 24) point, for example, at an angle of 15° outwards relative to the center plane.

This arrangement with outwardly inclining radial nozzle apertures 6 has the effect that during operation, that is, when air is discharged through the nozzle apertures 6, by passage of a thin, for example, a flattened bag-shaped plastic film web (with a total thickness of the magnitude 2×8 μm) around the tubular cylinder 2, a supporting air film is formed, which due to the angle of outward inclination of the nozzle apertures 6, a smoothening or tensioning effect is produced, which—without producing any kind of deformation forces—contributes to counteract crease formation in the plastic film web.

It should be noted that the tubular cylinder 2 which at opposite ends is rotatably suspended on ball bearings 16 and 18 by initiation of a given reversing of a plastic film web will rotate in the direction of movement due to the friction between the plastic film web and the tubular cylinder 2. But when the air film has been established between the tubular cylinder 2 and the plastic film web, the tubular cylinder 2 will find its neutral state and then stand still.

Figure 6:
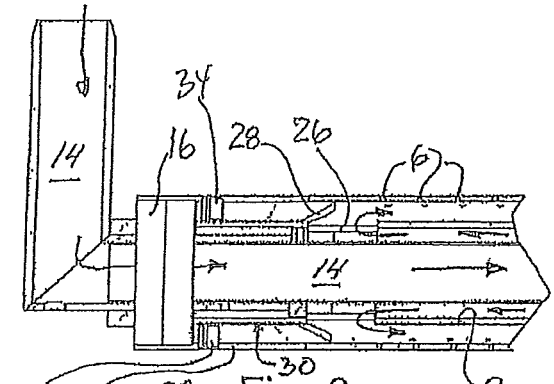
FIG. 6 shows a plan sectional view of a left end part of a tubular cylinder, cf.
Figure 7:
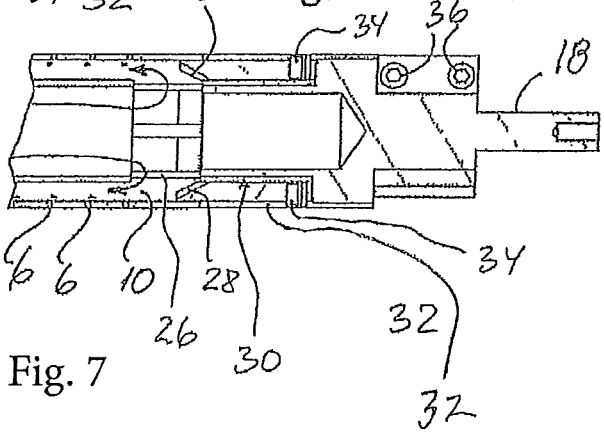
FIG. 7 shows a plan sectional view of a right end part of a tubular cylinder, cf.
Figure 8:
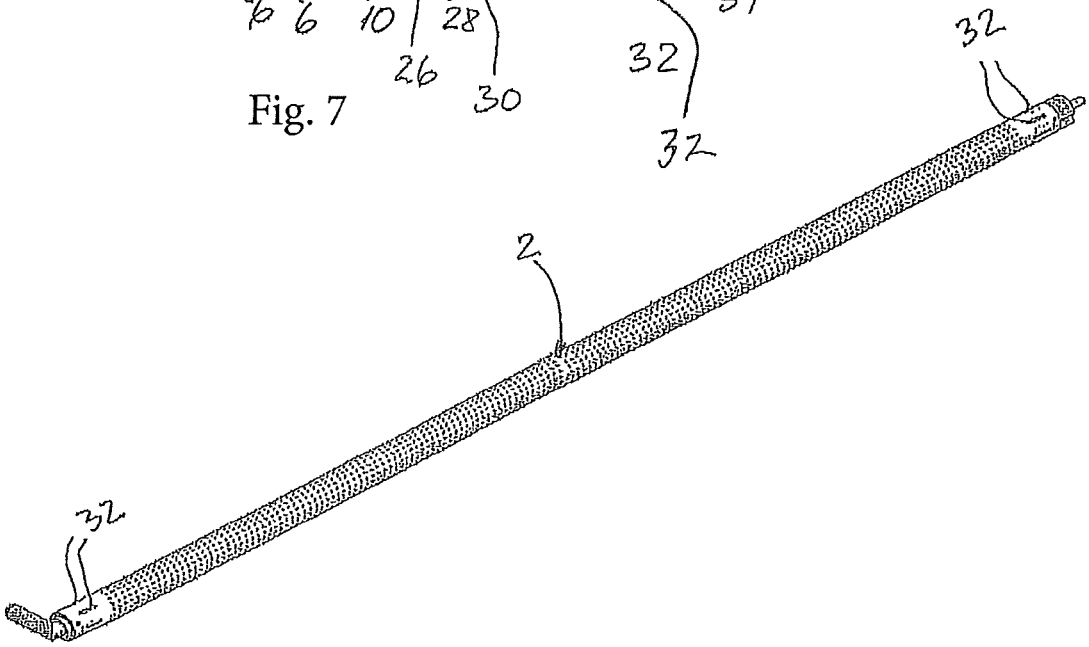
FIG. 8 shows a perspective view of a preferred tubular cylinder according to the invention.

FIGS. 6 and 7 show that the tubular cylinder 2 at opposite ends are designed with radial connections 26 between the inner tube 8 and the longitudinal curving air ducts 12. Opposite the radial connections 26, regulators 28 are displaceably arranged relative to the arrestors 30 to be accessible for displacement along radial connections 26 through outwardly open slots 32 and which can be locked into desired position by pointed screws 34.

By means of this regulating arrangement, it is possible to regulate the resulting airflow out through the radial nozzle apertures 6 such that the air film between the plastic film web and the tubular cylinder 2 is optimized correspondingly.

At the right end (FIG. 7) a stopper 36 is shown which intended for use by alternative fixation to the tubular cylinder 2, for example, by a rotation of 180°, for extending the service life of the tubular cylinder 2—to in other words enable turning of the tubular cylinder 2 if one of its sides has become worn.

REFERENCE NUMBERS OF THE DRAWING

2 tubular cylinder
4 outer tube
6 radial nozzle apertures
8 inner tube
10 longitudinal radial partitionings
12 longitudinal curving air ducts
14 tubular supply duct
16 bearing means (left end)
18 bearing means (right end)
20 radial center plane
22 helical center line
24 outwardly directed angle (preferably 15°)
26 radial connections
28 regulator
30 arrestor
32 pointed screws
34 stopper

The invention claimed is:

1. A tubular cylinder for handling plastic film webs comprising:

an outer tube including nozzles which point in a direction to direct air radially outward from the outer tube, an inner tube disposed coaxially relative to the outer tube, partitions connecting the inner and outer tube to provide air ducts, the inner tube being connected to a duct for supplying air to the air ducts, cylinder bearings disposed at opposite ends of the cylinder for rotatably supporting the cylinder rotate; and wherein the nozzles are disposed on the outer tube along helixes, a first helix being wound in a first direction on a first side of a center plane of the cylinder and a second helix being wound in a second direction opposite the first direction on a second side of the center plane, the nozzles pointing in the direction away from the radial center plane, the duct for supplying air to the air ducts extending into the inner tube to cause air to be injected into the inner tube and to be partially conducted backward along an outer side of the tubular duct to a first end of the inner tube and to partially conducted backward along the outer side of the tubular duct to a second end of the inner tube and to be introduced into the air ducts and radially directed onward through the nozzles, connections disposed between an inner side of the inner tube and the air ducts, and longitudinally displaceable air regulators for optimizing airflow out through the nozzles and means for longitudinally fixing the longitudinally displaceable air regulators.

2. A tubular cylinder according to claim 1, wherein an outwardly directed angle of the nozzles relative to a line perpendicular to an outer surface of the outer tube relative to the center plane ranges between 1° and 50°.

3. A tubular cylinder according to claim 1 wherein spacing between adjacent rows of nozzles ranges from 5-50 mm.

4. A tubular cylinder according to claim 1, wherein the nozzles have an aperture diameter ranging between 0.5-5 mm.

5. A tubular cylinder according to claim 1, wherein at least one of the bearings includes an adjustable stopper for adjusting a working position of an outer face cylinder facing the plastic film web to permit rotation for prolonging a life of the cylinder.

6. A tubular cylinder for handling plastic film webs comprising:

an outer tube including nozzles which point in a direction to direct air radially outward from the outer tube, an inner tube disposed coaxially relative to the outer tube, partitions connecting the inner and outer tube to provide air ducts, the inner tube being connected to a duct for supplying air to the air ducts, cylinder bearings disposed at opposite ends of the cylinder for rotatably supporting the cylinder rotate; screws interacting with an inner wall of the air ducts; and wherein the nozzles are disposed on the outer tube along helixes, a first helix being wound in a first direction on a first side of a center plane of the cylinder and a second helix being wound in a second direction opposite the first direction on a second side of the center plane, the nozzles pointing in the direction away from the radial center plane, the duct for supplying air to the air ducts extending into the inner tube to cause air to be injected into the inner tube and to be partially conducted backward along an outer side of the tubular duct to a first end of the inner tube and to partially conducted backward along the outer side of the tubular duct to a second end of the inner tube and to be introduced into the air ducts and radially directed onward through the nozzles, connections disposed between an inner side of the inner tube and the air ducts, and longitudinally displaceable air regulators for optimizing airflow out through the nozzles and means for arresting which interacts with an inner wall of the air ducts to longitudinally fix the longitudinally displaceable air regulators.

* * * * *